US008640768B2

(12) United States Patent
Hall et al.

(10) Patent No.: US 8,640,768 B2
(45) Date of Patent: Feb. 4, 2014

(54) SINTERED POLYCRYSTALLINE DIAMOND TUBULAR MEMBERS

(76) Inventors: David R. Hall, Provo, UT (US); Ronald B. Crockett, Provo, UT (US); Neil Cannon, Provo, UT (US)

( * ) Notice: Subject to any disclaimer, the term of this patent is extended or adjusted under 35 U.S.C. 154(b) by 308 days.

(21) Appl. No.: 13/165,593

(22) Filed: Jun. 21, 2011

(65) Prior Publication Data

US 2012/0103595 A1 May 3, 2012

Related U.S. Application Data

(63) Continuation-in-part of application No. 12/915,812, filed on Oct. 29, 2010, now Pat. No. 8,365,820.

(51) Int. Cl.
*E21B 33/12* (2006.01)

(52) U.S. Cl.
USPC ..... 166/194; 166/300; 175/231

(58) Field of Classification Search
USPC ..... 175/231, 232, 317; 166/194, 330, 334.4
See application file for complete search history.

(56) References Cited

U.S. PATENT DOCUMENTS

| | | | |
|---|---|---|---|
| 1,258,418 | A | 3/1918 | Kemble |
| 1,712,948 | A | 5/1929 | Burch |
| 1,921,135 | A | 8/1933 | Santiago |
| 2,153,034 | A | 4/1939 | Baker |
| 2,170,452 | A | 8/1939 | Grant |
| 2,320,670 | A | 6/1943 | Scaramucci |
| 2,427,052 | A | 9/1947 | Grant |
| 2,737,244 | A | 3/1956 | Baker |
| 3,039,531 | A | 5/1962 | Scott |
| 3,126,065 | A | 3/1964 | Chadderdon |
| 3,130,783 | A | 4/1964 | Orr |
| 3,403,729 | A | 10/1968 | Hickey |
| 3,703,104 | A | 11/1972 | Tamplen |
| 3,823,773 | A | 7/1974 | Nutter |
| 3,986,554 | A | 10/1976 | Nutter |
| 4,033,408 | A | 7/1977 | Fredd |
| 4,081,042 | A | 3/1978 | Johnson |
| 4,132,243 | A | 1/1979 | Kuus |
| 4,266,605 | A | 5/1981 | LaBorde |
| 4,491,187 | A | 1/1985 | Russell |
| 4,574,894 | A | 3/1986 | Jadwin |
| 4,655,289 | A | 4/1987 | Schoeffler |
| 4,889,199 | A | 12/1989 | Lee |
| 4,895,214 | A | 1/1990 | Schoeffler |
| 5,040,501 | A | 8/1991 | Lemelson |
| 5,230,390 | A | 7/1993 | Zastresek |
| 5,316,094 | A | 5/1994 | Pringle |
| 5,392,862 | A | 2/1995 | Swearingen |
| 5,499,687 | A | 3/1996 | Lee |
| 5,553,678 | A | 9/1996 | Barr |
| 5,609,178 | A | 3/1997 | Hennig |
| 5,673,763 | A | 10/1997 | Thorp |
| 5,685,379 | A | 11/1997 | Barr |
| 5,695,015 | A | 12/1997 | Barr |
| 5,706,905 | A | 1/1998 | Barr |
| 5,730,222 | A | 3/1998 | Rike |

(Continued)

*Primary Examiner* — William P Neuder
(74) *Attorney, Agent, or Firm* — Philip W. Townsend, III

(57) ABSTRACT

In one aspect of the present invention, an external tubular member comprises an external outside surface and an external inside surface joined by an external wall thickness. The external wall thickness comprises external sintered polycrystalline diamond. An internal member comprises an internal outside surface and an internal width. The internal width comprises internal sintered polycrystalline diamond. The external inside surface is adjacent to the internal outside surface.

20 Claims, 16 Drawing Sheets

(56) References Cited

U.S. PATENT DOCUMENTS

| | | | | |
|---|---|---|---|---|
| 5,803,185 | A | 9/1998 | Barr | |
| 6,089,332 | A | 7/2000 | Barr | |
| 6,142,250 | A | 11/2000 | Griffin | |
| 6,390,200 | B1 | 5/2002 | Allamon | |
| 6,431,270 | B1 | 8/2002 | Angle | |
| 6,717,283 | B2 | 4/2004 | Skinner | |
| 6,732,817 | B2 | 5/2004 | Dewey | |
| 6,776,240 | B2 | 8/2004 | Kenison | |
| 6,854,953 | B2 | 2/2005 | Van Drentham-Susman | |
| 6,920,930 | B2 | 7/2005 | Allamon | |
| 7,036,611 | B2 | 5/2006 | Radford | |
| 7,048,078 | B2 | 5/2006 | Dewey | |
| 7,308,937 | B2 | 12/2007 | Radford | |
| 7,331,397 | B1 | 2/2008 | Wagley | |
| 8,365,820 | B2 * | 2/2013 | Hall et al. | 166/194 |
| 2005/0145417 | A1 | 7/2005 | Radford | |
| 2007/0062706 | A1 | 3/2007 | Leising | |
| 2007/0107944 | A1 | 5/2007 | Lee | |
| 2008/0105464 | A1 | 5/2008 | Radford | |
| 2012/0103595 | A1 * | 5/2012 | Hall et al. | 166/194 |

* cited by examiner

SINTERED POLYCRYSTALLINE DIAMOND TUBULAR MEMBERS

This application is a continuation-in-part of U.S. patent application Ser. No. 12/915,812, which was filed on Oct. 29, 2010 now U.S. Pat. No. 8,365,820. U.S. Pat. No. 8,365,280 is herein incorporated by reference for all that it discloses.

BACKGROUND OF THE INVENTION

The present invention relates to the field of diamond enhanced valves. The prior art discloses diamond coatings or films on valve surfaces deposited by vapor deposition. Diamond is grown in a vapor deposition process by disposing a substrate in an environment that encourages diamond grain growth. The substrate may be exposed to gases comprising carbon and hydrogen. These gases may be deposited onto the substrate causing grain growth. The vapor deposition process may occur under low pressure, between one and twenty seven kPa. The diamond formed by chemical vapor deposition may comprise anisotropic properties, properties with different values when measured in different directions. The diamond grains may also be loosely bonded to one another as the process occurs at low pressure.

U.S. Pat. No. 5,040,501 to Lemelson, which is herein incorporated by reference for all that is contains, discloses valves. In one form, a select portion of the surface of a valve component or components subject to degradation during use such as erosive and/or corrosive effects of fluid particles and liquid or vaporous fluid passing through the valve, is coated with a synthetic diamond material which is formed in situ thereon. In another form, the entire surface of the valve component is so coated. The component may be a movable poppet member for an exhaust valve for a combustion chamber of an internal combustion piston engine. The valve seat or insert may also be coated with synthetic diamond material, particularly the circular tapered inside surface thereof against which a portion of the underside of the head of the valve poppet which engages the seat when the valve is spring closed. By coating the entire head and stem of the valve poppet with synthetic diamond and overcoating or plating a solid lubricant, such as chromium on the outer surface of the diamond coating a number of advantages over conventional valve construction are derived including better heat and corrosion resistance, reduced wear resulting from seat and valve head impact contact and a reduction in the enlargement of surface cracks. Similar improvements are effected for the valve seat when so coated and protected. In a modified form, the entire interior or selected portions of the wall of the valve body or the combustion chamber containing the valve may be coated with synthetic diamond material with or without a protective overcoating.

BRIEF SUMMARY OF THE INVENTION

In one aspect of the present invention, an external tubular member comprises an external outside surface and an external inside surface joined by an external wall thickness. The external wall thickness comprises external sintered polycrystalline diamond. An internal member comprises an internal outside surface and an internal width. The internal width comprises internal sintered polycrystalline diamond. The external inside surface is adjacent to the internal outside surface.

A seal may be formed intermediate the external inside surface and the internal outside surface. The external inside surface may be finished to provide a low friction, rotary surface against the internal outside surface. In some embodiments, the external tubular member and the internal member may form a rotary valve.

The internal and external polycrystalline diamond may comprise diamond grains with diameters between ten and twenty micrometers and a metal catalyst concentration of five to twenty five percent by weight. The polycrystalline diamond of the external inside surface may comprise a depleted thickness comprising minimal metal catalyst.

The external polycrystalline diamond may form at least a portion of the external outside surface, the external inside surface, and the entire wall thickness therebetween. The external polycrystalline diamond may be bonded to an external tubular member made of a cemented metal carbide at an external interface. In some embodiments, the external interface may be non-planar. In some embodiments the external polycrystalline diamond may be bonded to a first and second carbide member at first and second external interfaces.

The external outside surface and the external inside surface of the external tubular member may be joined by at least one external lateral bore. In some embodiments, the external polycrystalline diamond may be press fit within an external lateral bore.

The internal polycrystalline diamond may be bonded to an internal carbide member made of a cemented metal carbide at an internal interface. The internal member may comprise a bore through the internal width along a length of the internal member. The bore and the internal outside surface of the internal member may be joined by at least one internal lateral bore. In some embodiments, the internal polycrystalline diamond may be press fit within an internal lateral bore formed within the internal width. The press fit internal or external polycrystalline diamond may comprise at least one cylindrical structure.

The internal member may be configured to move axially within the external tubular member. In some embodiments, the external tubular member and the internal member form a reciprocating valve.

The internal member may be rigidly connected to a drive shaft. The drive shaft may be configured to rotate and/or axially translate the internal member within the external tubular member.

DETAILED DESCRIPTION OF THE INVENTION AND THE PREFERRED EMBODIMENT

Figure 1:
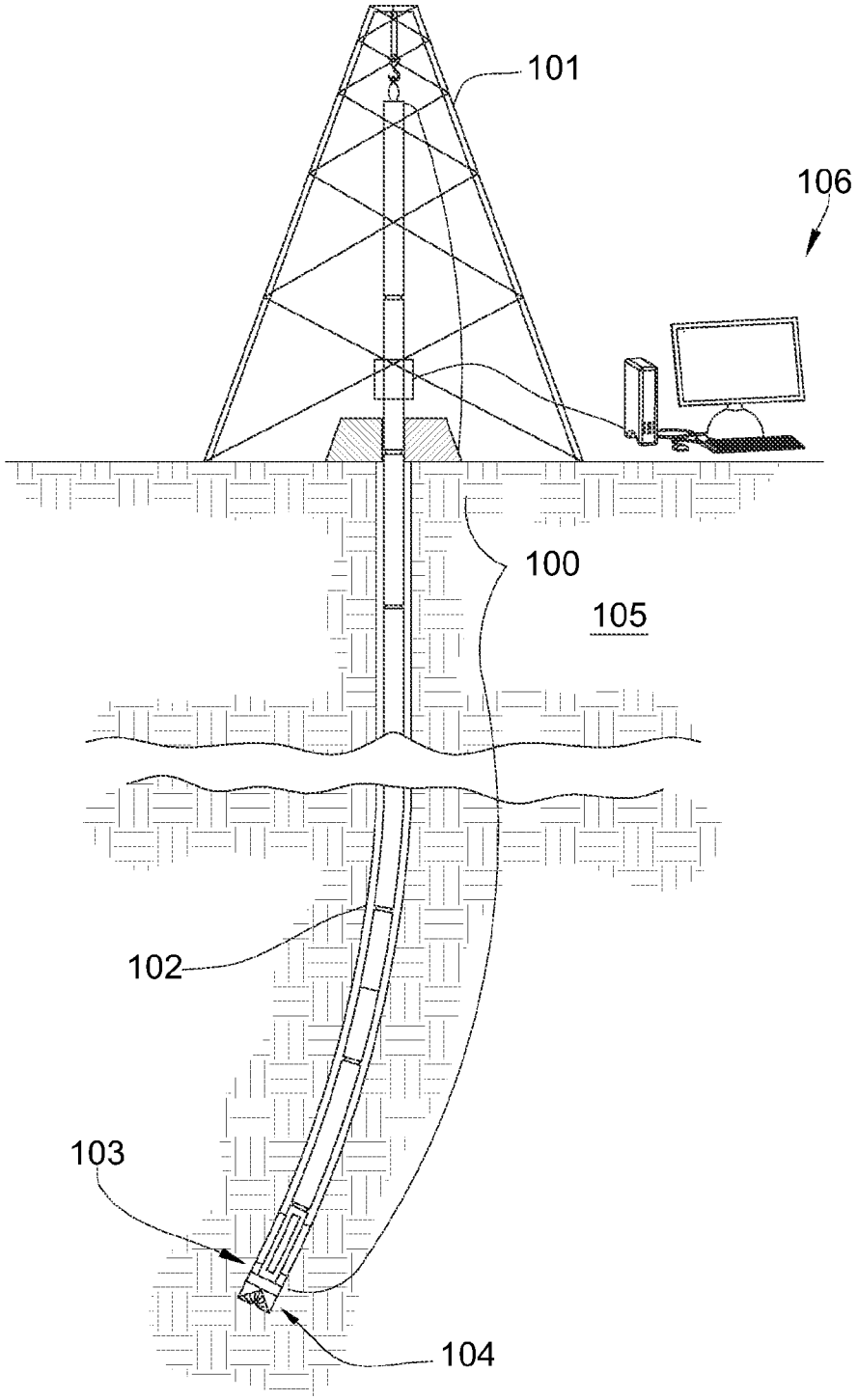
FIG. 1 is a perspective view of an embodiment of a drilling operation.

Referring now to the figures, FIG. 1 discloses a perspective view of an embodiment of a drilling operation comprising a downhole tool string 100 suspended by a derrick 101 in a borehole 102. A steering assembly 103 may be located at the bottom of the borehole 102 and may comprise a drill bit 104. As the drill bit 104 rotates downhole, the downhole tool string 100 may advance farther into the earth. The downhole tool string 100 may penetrate soft or hard subterranean formations 105. The steering assembly 103 may be adapted to steer the drill string 100 along a desired trajectory. The downhole tool string 100 may comprise electronic equipment that is able to send signals through a data communication system to a computer or data logging system 106 located at the surface.

Figure 2:
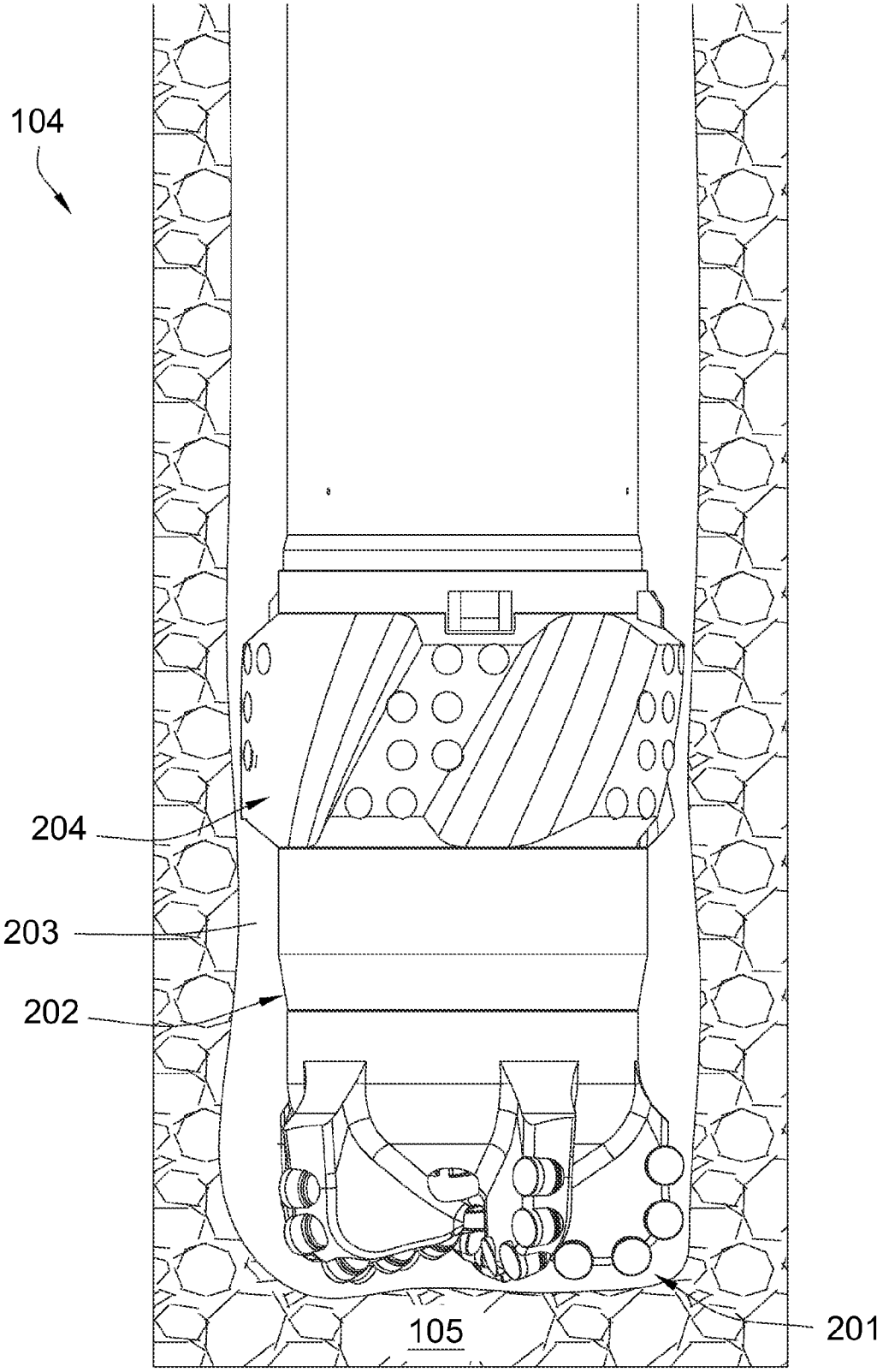
FIG. 2 is a perspective view of an embodiment of a drill bit.

FIG. 2 discloses a perspective view of an embodiment of the drill bit 104 comprising a cutting portion 201 and an outer diameter 202. The drill bit 104 may comprise a plurality of blades converging at the center of the cutting face 201 and diverging at the outer diameter 202. In some embodiments, the outer diameter 202 is a gauge portion of the drill bit 104. The blades may be equipped with cutting elements that may degrade the formation 105. Fluid from drill bit nozzles may remove formation fragments from the bottom of the borehole and carry them up an annulus 203 of the borehole.

A fluid actuated tool may be incorporated into the drill string, such as a steering ring 204 that may be disposed around the outer diameter 202. During drilling operations, the steering ring 204 may contact the formation 105 and steer the drill string in a desired trajectory. Other fluid actuated tools may include reamers, jars, seismic sources, expandable stabilizers, steering mechanisms, moveable drill bit indenters, or any downhole tool with fluid driven movable parts. The flow of fluid to the movable components of these tools may be controlled by a valve.

Valves located in downhole tool strings are subjected to erosive fluid flow, as well has high pressures and high temperatures from the downhole ambient environment. Further, tool string vibrations from the drilling action may contribute to decreasing the life of most downhole components, include valves.

Figure 3:
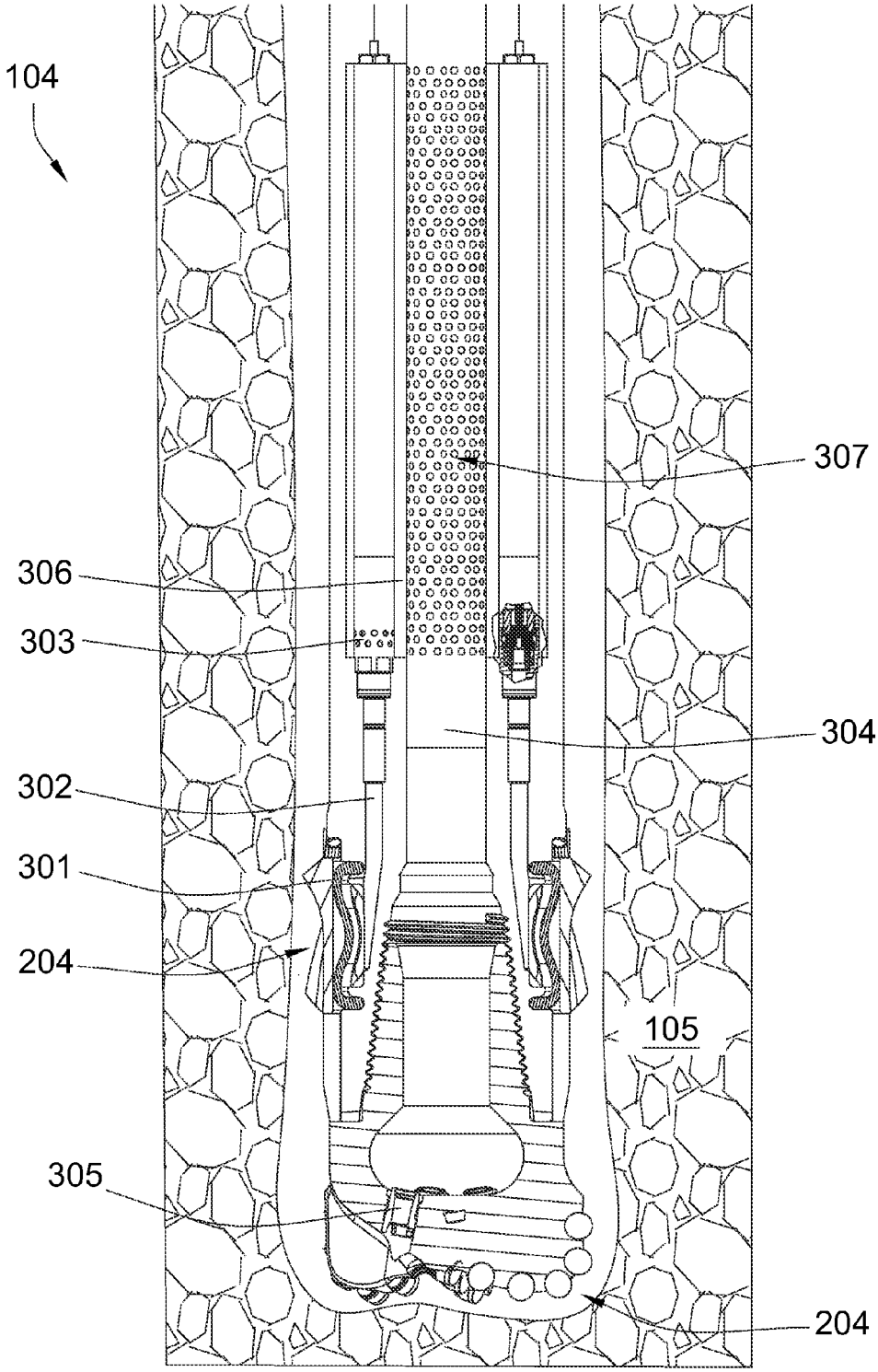
FIG. 3 is a cross-sectional view of another embodiment of a drill bit.

For embodiments with a steering ring, such as disclosed in FIG. 3, a portion of flow of drilling fluid may be directed through a fluid channel 302 that causes a biasing mechanism 301 to push the steering ring 204 into the formation 105. A valve 303 may be configured to control the amount of drilling fluid that flows through the fluid channel 302. When the valve 303 is closed, drilling fluid may be prevented from entering the fluid channel 302 and the drilling fluid may remain in a bore 304 of the drill string and flow out of nozzles 305 at the cutting portion 201. The valve 303 may be controlled by a telemetry system or an electronic circuitry system.

In some embodiments, a plurality of biasing mechanisms 301 may be used to control the steering ring 204. Each biasing mechanism 301 may receive a flow of drilling fluid that may be controlled by a valve 303. The plurality of valves 303 may be disposed around the bore 304. As shown in the present embodiment, a plurality of fluid cavities 306 may be disposed within the wall of the bore 304 and each valve 303 may be disposed within a fluid cavity 306. Each fluid cavity 306 may be in fluid communication with the bore 304 and be configured to immerse the valve 303 in fluid. A filter 307 may be disposed intermediate the bore 304 and each of the fluid cavities 306, and be configured to act as a selectively permeable surface. The filter 307 may be disposed along a length of the fluid cavity 306 which may allow maximum effectiveness. The flow of drilling fluid within the bore 304 may remove buildup that accumulates on the filter 307.

Figure 4:
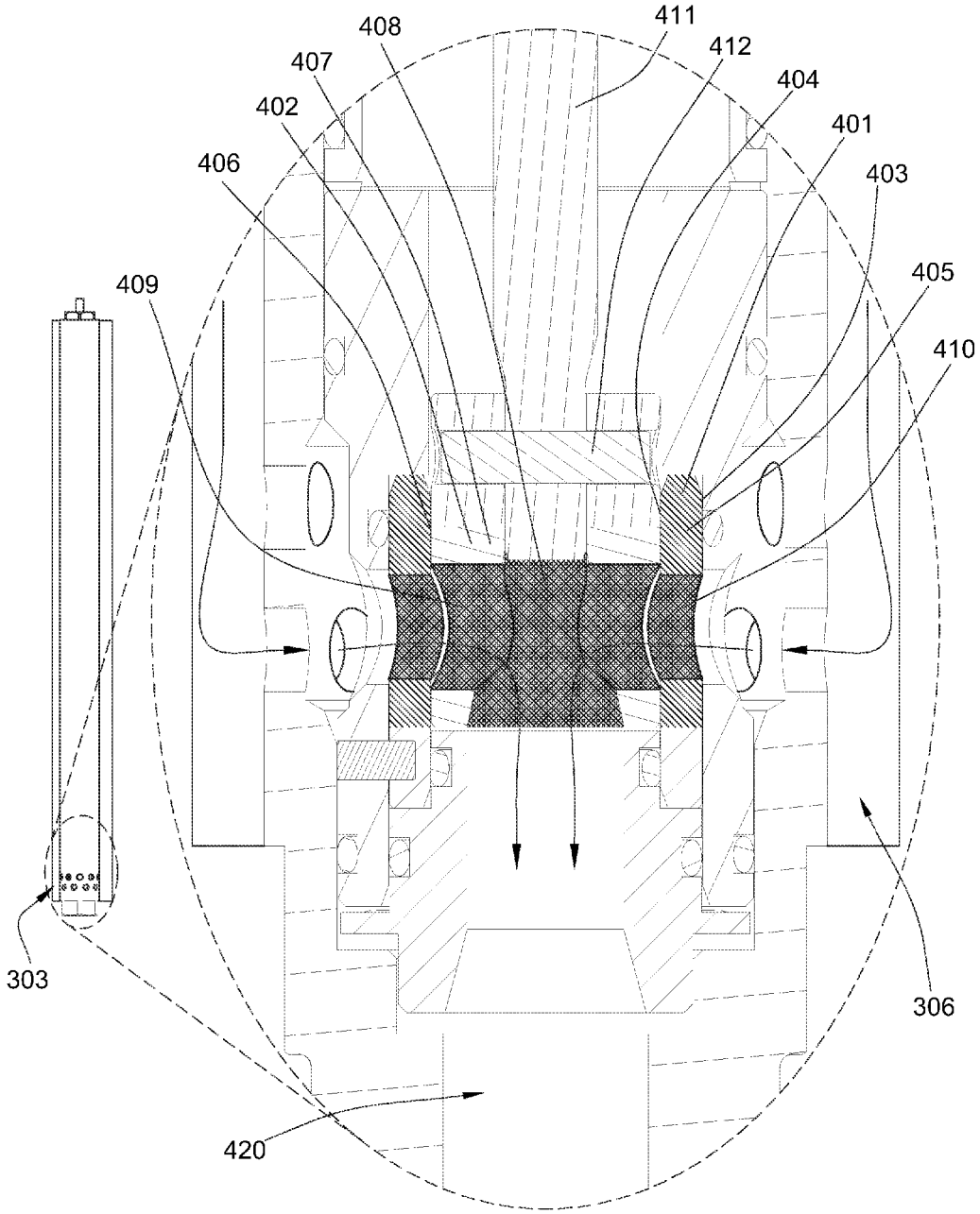
FIG. 4 is a cross-sectional view of an embodiment of a valve.

FIG. 4 discloses a cross-sectional view of the valve 303. In the present embodiment, the valve 303 is a rotary valve.

The valve 303 may comprise an external tubular member 401 and an internal member 402. The external tubular member 401 may comprise an external outside surface 403 and an external inside surface 404 joined by an external wall thickness 405. The internal member 402 may comprise an internal outside surface 406 and an internal width 407. The external inside surface 404 may be adjacent to the internal outside surface 406.

The internal member 402 may comprise an internal bore 408 through the internal width 407 and along a length of the internal member 402. The internal bore 408 and the internal outside surface 406 may be joined by at least one internal lateral bore 409. The external outside surface 403 and the external inside surface 404 of the external tubular member 401 may be joined by at least one external lateral bore 410.

When the valve 303 is in an open position, fluid from the fluid cavity 306 may pass through the external lateral bore 410, through the internal lateral bore 409, and into a fluid passage 420. A seal may be formed intermediate the external inside surface 404 of the external tubular member 401 and the internal outside surface 406 of the internal member 402. The seal may be formed by the internal member 402 residing within the external tubular member 401 such that a fit is configured to prohibit a significant amount of fluid to flow between the external tubular member 401 and the internal member 402.

The valve 303 may open and close as the internal member 402 rotates within the external tubular member 401. As the internal member 402 rotates, the internal lateral bore 409 may align and misalign with the external lateral bore 410 allowing and disallowing fluid to pass. The internal member 402 may be rigidly connected to a drive shaft 411 by a pin 412. The drive shaft 411 may be also connected to an actuator (not shown) which may rotate the drive shaft 411 and consequently rotate the internal member 402.

The external wall thickness 405 may comprise external sintered polycrystalline diamond that spans from the external outside surface 403 to the external inside surface 404. The entire thickness may comprise sintered polycrystalline diamond. The internal width 407 may also comprise internal sintered polycrystalline diamond. Portion of the internal member may comprise widths that are entirely made of sintered polycrystalline diamond. The fluid flowing through the valve 303 may be abrasive and may impose erosive forces on the valve components that may be easily handled by the sintered polycrystalline diamond.

The external and internal sintered polycrystalline diamond may be sintered a in high-pressure and high-temperature press that substantially applies pressure uniformly from all directions resulting in the sintered polycrystalline diamond exhibiting isotropic characteristics. During sintering, diamond grains may be mixed with a metal catalyst that lowers the activation energy required to cause the grains to grow and bond to one another. The high density and isotropic properties of the sintered polycrystalline diamond may be advantageous because the fluid may impose loads on the valve components from a plurality of directions. Further, the rotary action of the valve may generate strains from different directions. Also, the high temperature from the ambient downhole environment, which may exceed 300 degrees Celsius in geothermal drilling applications, may also cause all of the valves components to thermally expand. The isotropic nature of the sintered polycrystalline diamond allows for uniform thermal expansion across the entire width of the internal member and the thickness of the external member. Further, the isotropic impact resistance, elasticity, and abrasion resistance are well suited for all of the external loads imposed upon the valve components.

The sintered polycrystalline diamond surfaces are well suited as bearing surfaces. Since the sintered polycrystalline diamond is strong in all directions, these diamond surfaces may slide against each other. Also, the sintered polycrystalline diamond surfaces are inert, so the surfaces may slide against each other with minimal friction and chemical adhesion. In some embodiments, the metal catalyst used during sintering may be removed prior to the valve's use to further improve the sintered polycrystalline diamond's surface. Due to sintered polycrystalline diamond's low friction, less heat is generated than in prior art valves, thus, less heat is generated between the moving parts.

Thus, the use of solid sintered polycrystalline diamond through the entire thickness of the external member's wall and the entire width of the internal member overcomes long standing problems in the art resulting from diamond coatings on valves, namely: failure due to different thermal expansion coefficients among the different layers of valve components, weak bonding interfaces between the underlying substrates and the coatings, and higher friction caused by irregularities (weak diamond to diamond bonds between columnar diamond grains) in vapor deposited diamond's molecular structure.

Sintered polycrystalline diamond is commonly used for cutters on drill bits. For abrasive applications, the cutters' diamond grains generally comprise diameters between four and eight micrometers. These small grain sizes minimize the diamond loss when a diamond grain is removed due to abrasion failing a diamond to diamond bond. However, cutters that are used in high impact applications generally use diamond grains with diameters between ten and twenty micrometers. The larger grains are believed to distribute the high loads more appropriately through the diamond compact upon impact. While the valves are primarily abrasive applications, larger grain sizes, in the range of ten and twenty micrometers, have found to be more efficient for sintered polycrystalline diamond valves.

Figure 5:
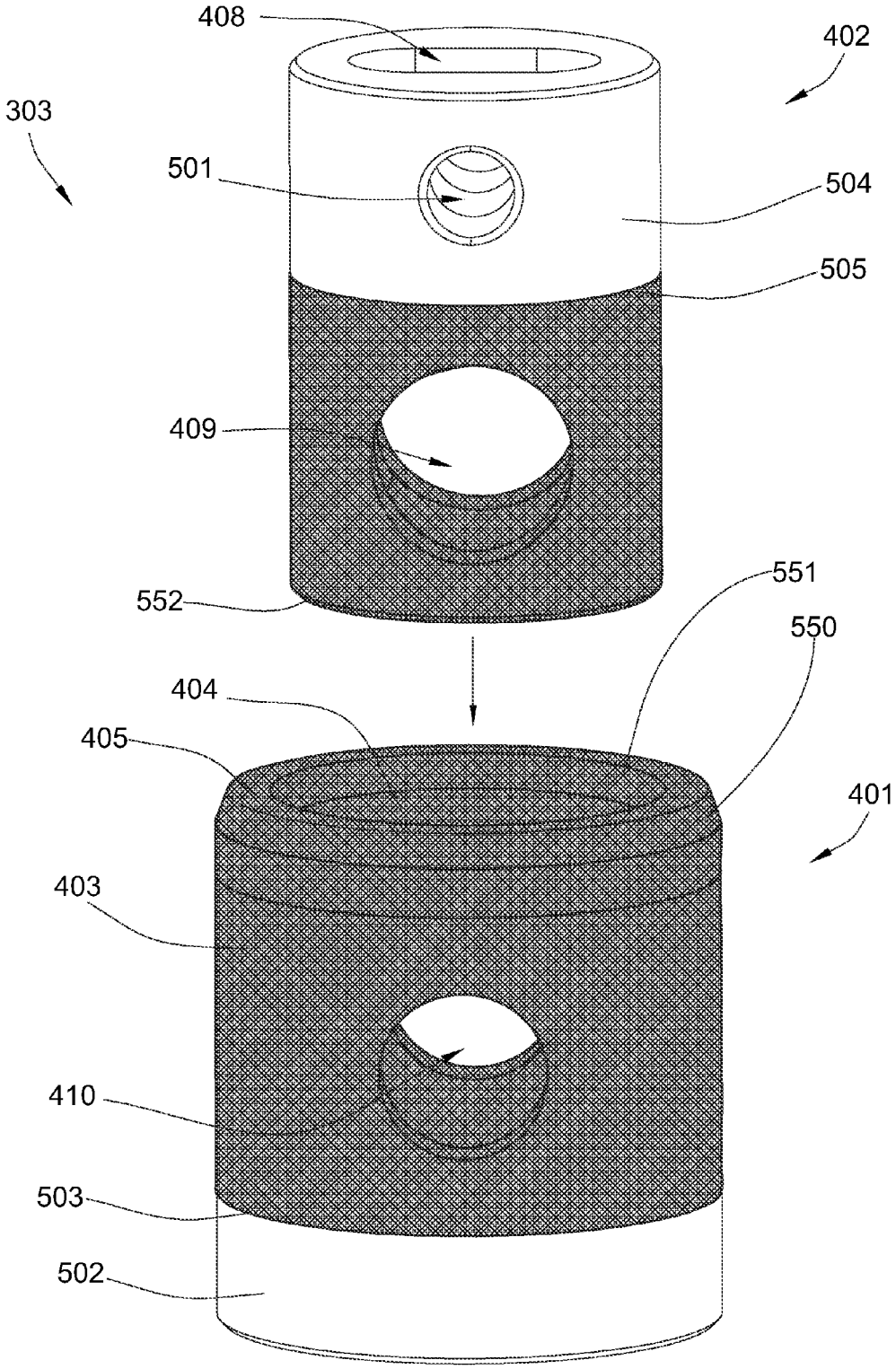
FIG. 5 is a perspective view of another embodiment of a valve.

FIG. 5 discloses a perspective view of another embodiment of the valve 303 comprising the external tubular member 401 and the internal member 402. As shown in the present embodiment, the external tubular member 401 may comprise the external lateral bore 410. The internal member 402 may comprise the internal bore 408 and the internal lateral bore 409. The internal member 402 may be configured to reside within the external tubular member 401.

The drive shaft may be disposed within the internal bore 408 and connected to the internal member 402 by a pin disposed within a port 501.

The external polycrystalline diamond may form at least a portion of the external outside surface 403, the external inside surface 404, and the entire wall thickness 405 therebetween. The external polycrystalline diamond may be bonded to an external tubular substrate 502 made of a cemented metal carbide at an external interface 503.

In some embodiments, the external interface is substantially normal to a central axis of the external member. The external tubular substrate may be used to attach the sintered diamond components to drive shafts, pins, or other components. Whereas prior art valves that used diamond coatings utilize a substrate to provide strength to the diamond, the external tubular substrate of the present embodiment does not support the diamond across its thickness because the sintered polycrystalline diamond is self-supporting. In some embodiments, the external tubular substrate is located away from any heat generating activity, such as friction between the external and internal members or the flow of fluid. The external interface may be substantially planar or non-planar. Also, the internal polycrystalline diamond may be bonded to an internal substrate 504 made of a cemented metal carbide at an internal interface 505.

In external outer bevel 550 and external inner bevel 551 may be used to help align the external member within the downhole tool or align the internal member within the external member's bore. Also, the internal member may comprise an internal outer bevel 552 to align the internal member within the bore.

Figure 6A:
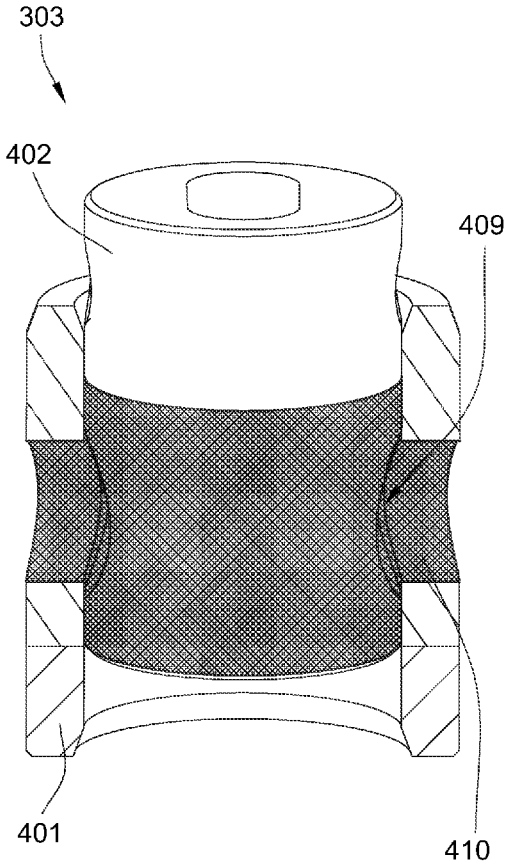
FIG. 6*a* is a partial cross-sectional view of another embodiment of a valve.

FIG. 6*a* discloses the internal member 402 configured to reside within the external tubular member 401. As shown in the present embodiment, the internal lateral bore 409 may align with the external lateral bore 410 which may enable the flow to travel through the valve 303.

Figure 6B:
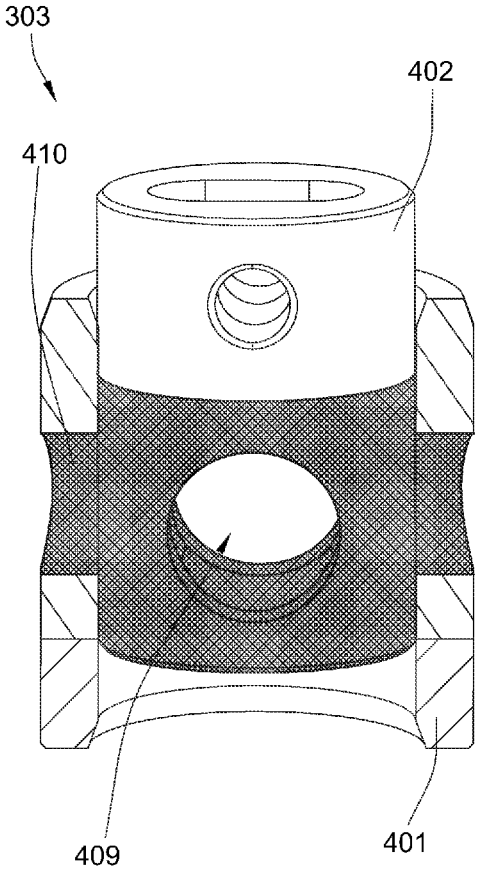
FIG. 6*b* is a partial cross-sectional view of another embodiment of a valve.

FIG. 6*b* discloses another embodiment of the valve 303. In the present embodiment, the internal lateral bore 409 of the internal member 402 and the external lateral bore 410 of the external tubular member 401 are misaligned, thus, blocking fluid flow.

Figure 7A:
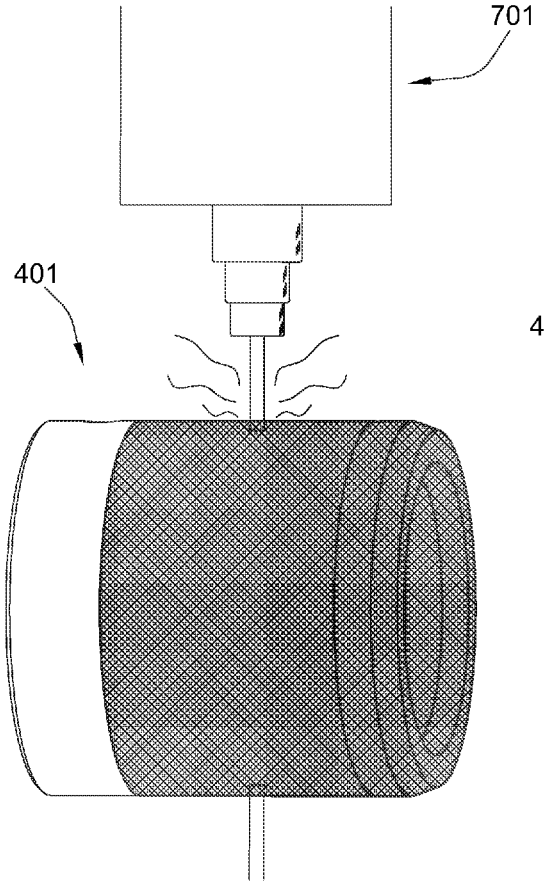
FIG. 7*a* is a perspective view of an embodiment of an external member and an electric discharge machine.

FIG. 7*a* discloses an embodiment of the external tubular member 401 being formed by an electric discharge machine (EDM) 701. EDM may be used to form both the internal and external members. The EDM 701 may remove a portion of the sintered polycrystalline diamond to form any of the bores. The EDM 701 may use high voltage currents to remove the external polycrystalline diamond. The metal catalyst disposed within the sintered polycrystalline diamond may carry the charge from the EDM 701 over a given area. The metal catalyst of the internal and external polycrystalline diamond may comprise a metal catalyst concentration between five and twenty five percent by weight. Continuous wire EDM, plunge EDM, or other EDM methods may be used to form the bore.

Figure 7B:
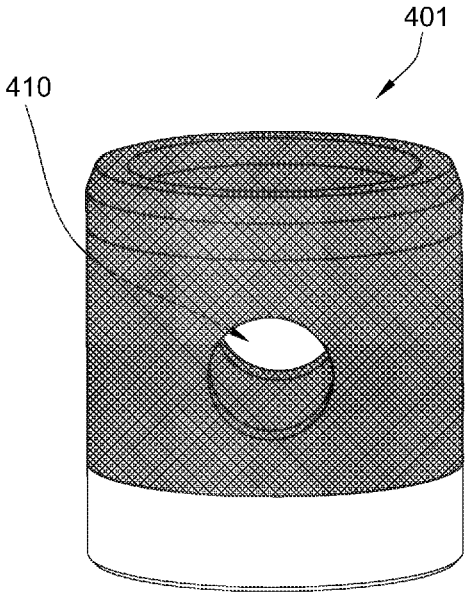
FIG. 7*b* is a perspective view of an embodiment of an external member.

FIG. 7*b* discloses a perspective view of another embodiment of the external member 401. The external member 401 may comprise the external lateral bore 410 formed by the EDM 701.

Figure 8:
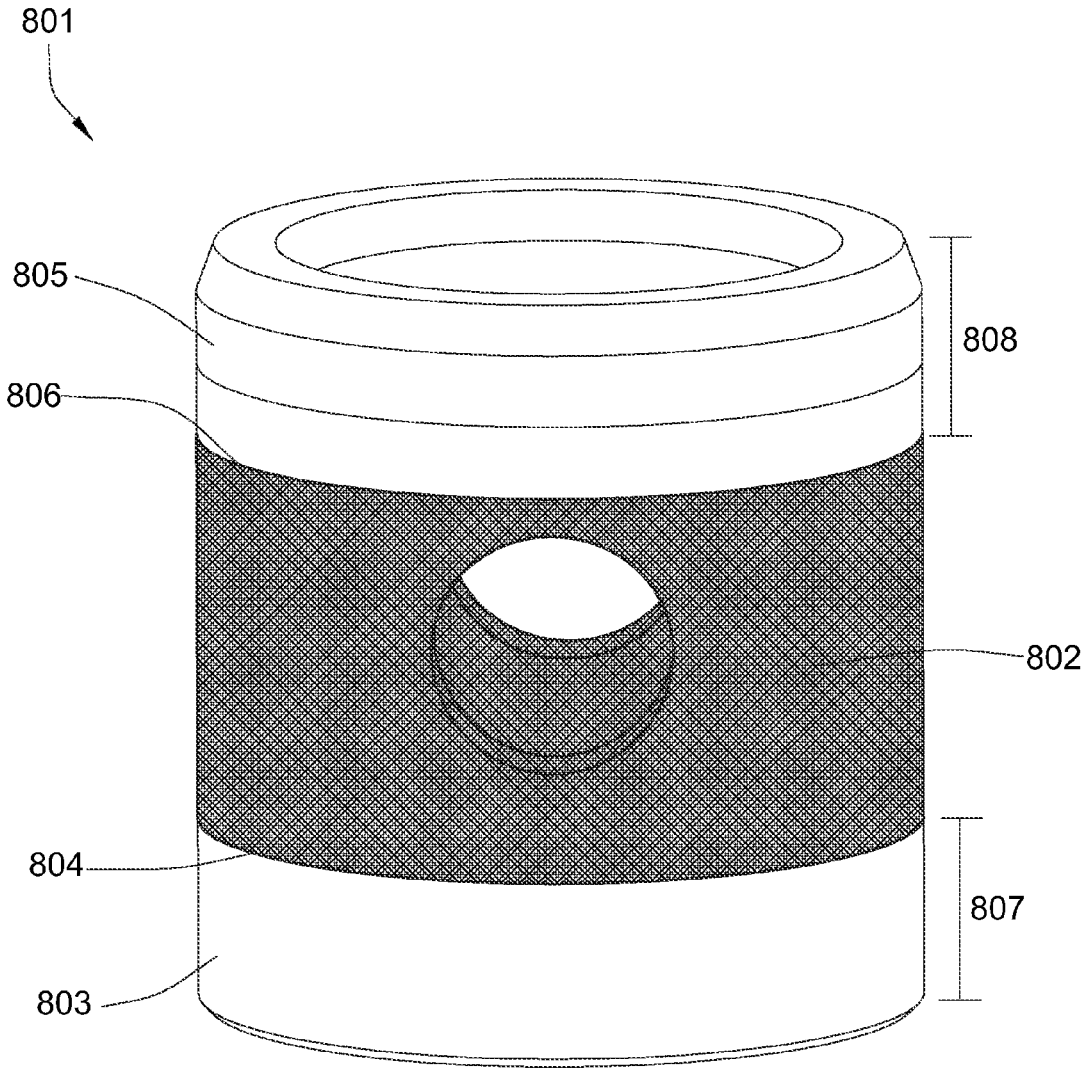
FIG. 8 is a perspective view of another embodiment of an external member.

FIG. 8 discloses a perspective view of an embodiment of an external tubular member 801. The external tubular member 801 may comprise external polycrystalline diamond 802 bonded to a first external tubular carbide member 803 at a first external interface 804 and a second external tubular carbide member 805 at a second external interface 806. Sizes 807 and 808 of the first and second external tubular carbide members 803 and 805 respectively, may be varied such that the external tubular member 801 may securely fit into its environment.

Figure 9:
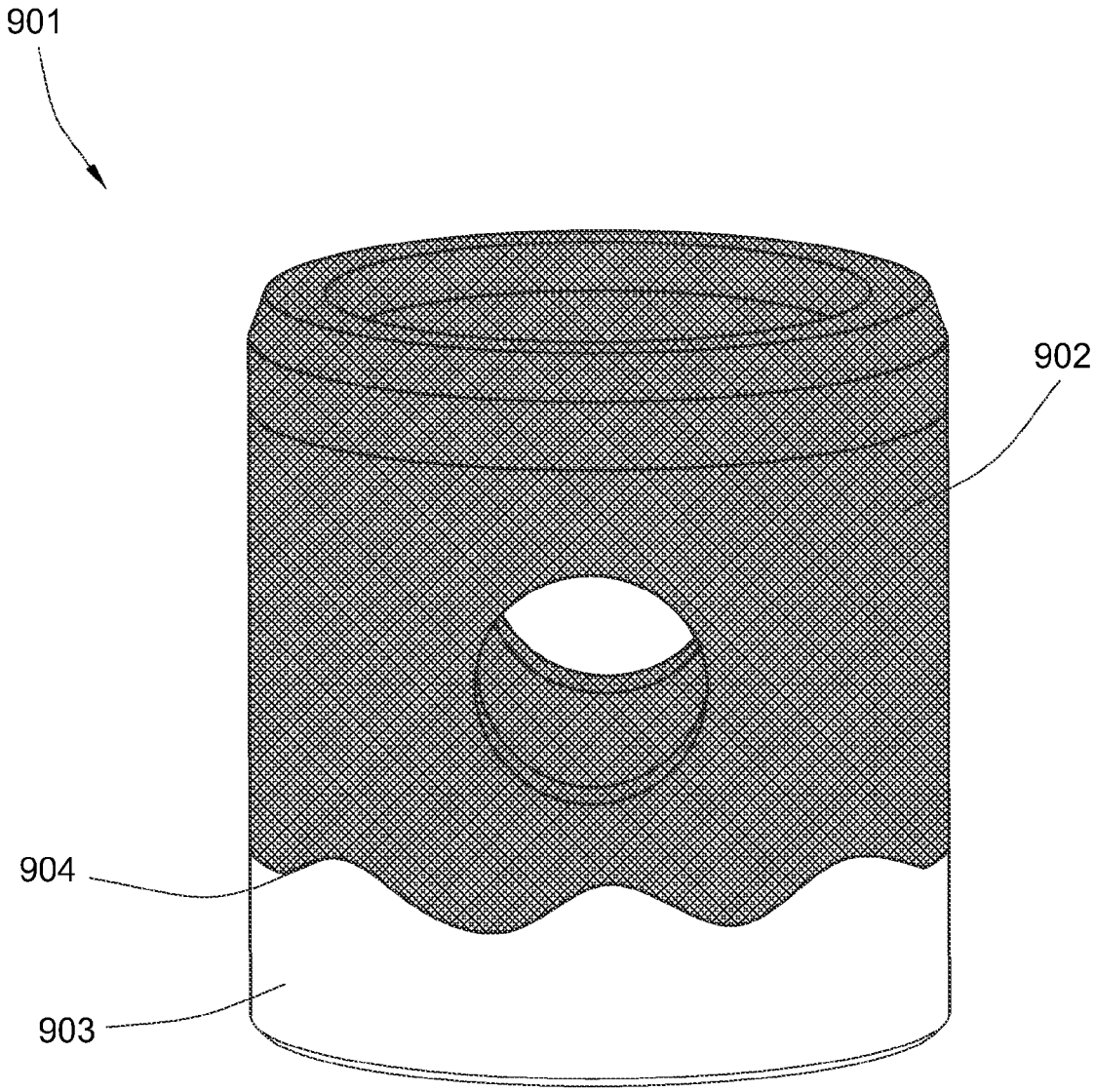
FIG. 9 is a perspective view of another embodiment of an external member.

FIG. 9 discloses a perspective view of an embodiment of an external tubular member 901. The external tubular member 901 may comprise external polycrystalline diamond 902 bonded to an external tubular member 903 at an external interface 904. As shown in the present embodiment, the external interface 904 may be non-planar.

Figure 10A:
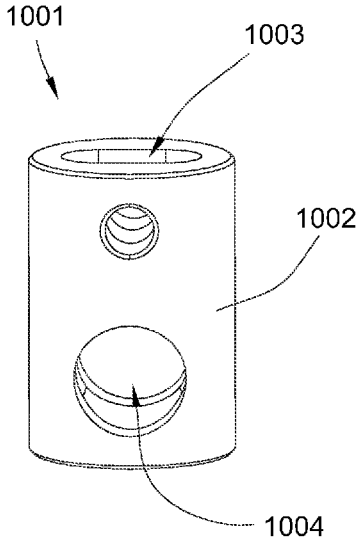
FIG. 10*a* is a perspective view of an embodiment of an internal member.

FIG. 10*a* discloses a perspective view of an embodiment of an internal member 1001 prior to being configured with portions of internal sintered polycrystalline diamond. Although the present embodiment discloses the internal member 1001, an external tubular member may comprise a substantially similar structure.

The internal member 1001 may comprise an internal outside surface 1002 and an internal bore 1003 along a length of the internal member 1001. The internal bore 1003 and the internal outside surface 1002 may be joined by at least one internal lateral bore 1004.

Figure 10B:
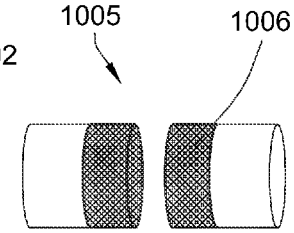
FIG. 10*b* is a perspective view of an embodiment of a plurality of cylindrical structures.

FIG. 10*b* discloses a perspective view of an embodiment of a plurality of cylindrical structures 1005. The cylindrical structures 1005 may comprise internal sintered polycrystalline diamond 1006. In the present embodiment, the cylindrical structures 1005 are readily available cutting elements.

Figure 10C:
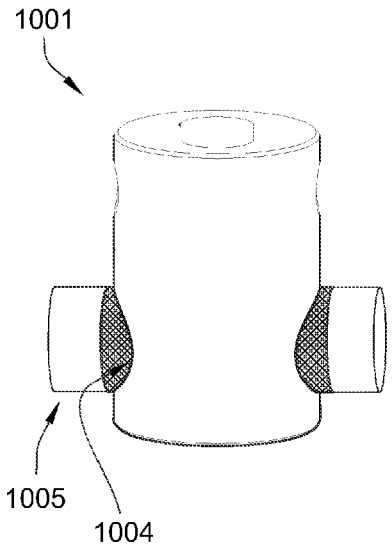
FIG. 10*c* is a perspective view of another embodiment of an internal member.

FIG. 10*c* discloses a perspective view of another embodiment of the internal member 1001 wherein the plurality of cylindrical structures 1005 are disposed within the internal lateral bore 1004. The cylindrical structures 1005 may be disposed within the internal lateral bore 1004 such that the internal sintered polycrystalline diamond may be press fit into the internal lateral bore 1004.

Figure 11A:
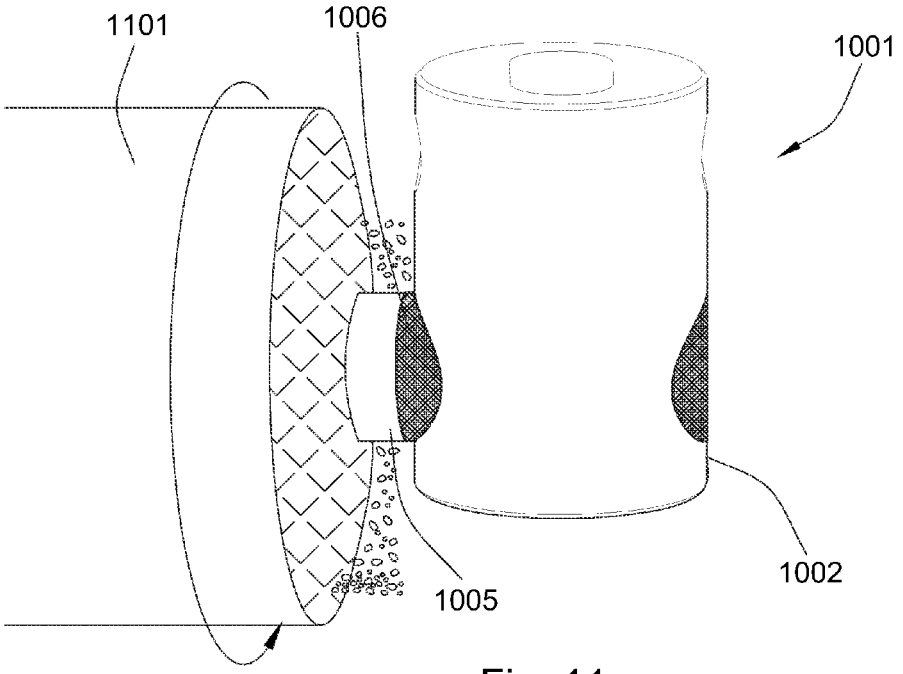
FIG. 11*a* is a perspective view of an embodiment of an internal member and a grinding machine.

FIG. 11*a* discloses a perspective view of another embodiment of the internal member 1001 after the cylindrical structures 1005 have been disposed within the internal lateral bore. A portion of the cylindrical structures 1005 may comprise carbide that may need to be removed. A grinding mechanism 1101 may be used to grind away the carbide portion of the cylindrical structure 1005. As the carbide portion is removed, the outside surface of the internal polycrystalline diamond 1006 may conform to the contour of the internal outside surface 1002

Figure 11B:
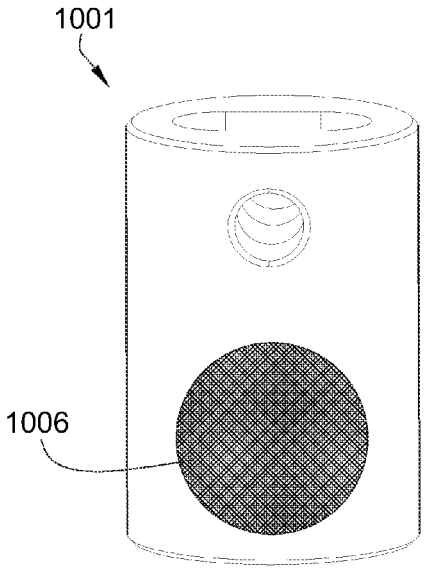
FIG. 11*b* is a perspective view of another embodiment of an internal member.

FIG. 11*b* discloses a perspective view of another embodiment of the internal member 1001 wherein the internal sintered polycrystalline diamond 1006 has been press fit into the lateral bore and the carbide of the cylindrical structures has been grinded away.

Figure 11C:
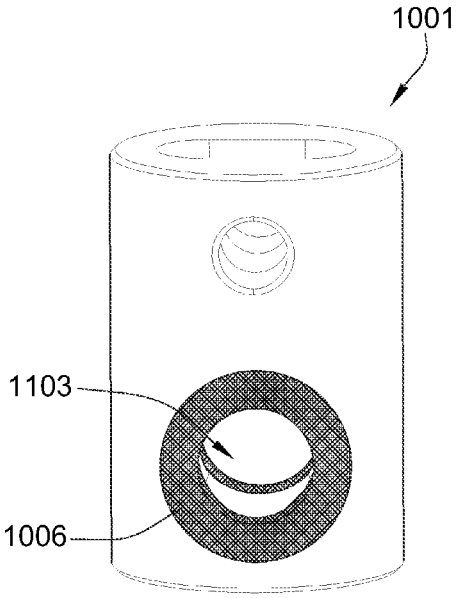
FIG. 11*c* is a perspective view of another embodiment of an internal member.

FIG. 11*c* discloses a perspective view of another embodiment of the internal member 1001 comprising a second internal lateral bore 1103. An electric discharge machine may be used to remove a portion of the internal polycrystalline diamond 1006 to form the second internal lateral bore 1103. The second internal lateral bore 1103 may be surrounded by the internal polycrystalline diamond 1006. It is believed that isolating the internal polycrystalline diamond 1006 around the second internal lateral bore 1103 may increase the life of the internal member 1001 because minimal cracking of the internal polycrystalline diamond 1006 may occur. The internal polycrystalline diamond 1006 may be disposed intermediate the flow and the internal member 1001.

Figure 12:
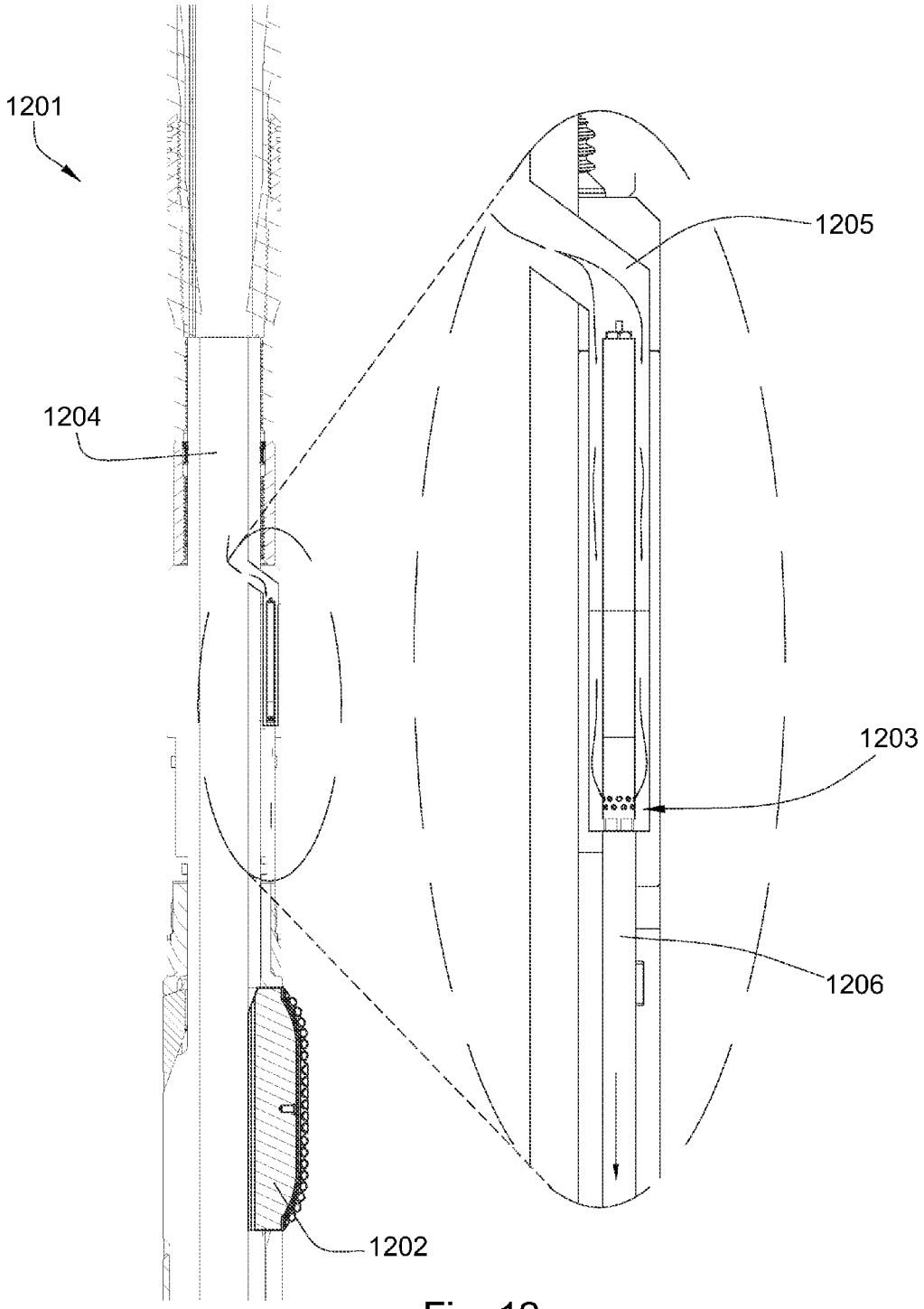
FIG. 12 is a cross-sectional view of an embodiment of a downhole component.

FIG. 12 discloses a cross-sectional view of an embodiment of a downhole component 1201 comprising an expandable tool 1202. In this embodiment, the expandable tool 1202 comprises a reamer which may expand and contact and degrade the formation. The expandable tool 1202 may be actuated with fluid that may be allowed and disallowed by a valve 1203. The valve 1203 may comprise an external tubular member and an internal member.

Some fluid flowing through a bore 1204 of the downhole component 1201 may flow through a conduit 1205. The valve 1203 may be disposed within the conduit 1205 such that fluid may immerse the valve 1203. After flowing through the valve 1203, the fluid may flow into a fluid passage 1206 and actuate the expandable tool 1202.

Figure 13:
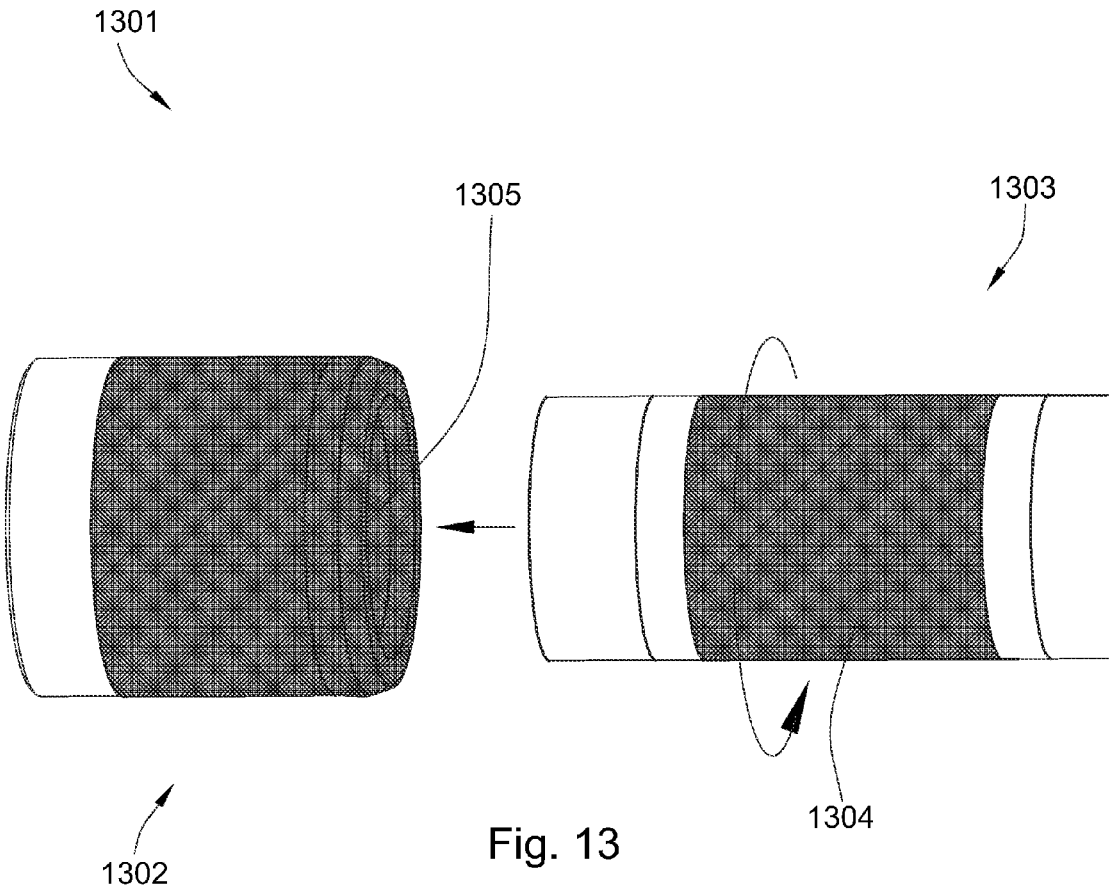
FIG. 13 is a perspective view of an embodiment of a rotary bearing.

FIG. 13 discloses a perspective view of an embodiment of a rotary bearing 1301. The rotary bearing 1301 may comprise an external tubular member 1302 and an internal member 1303 wherein the internal member 1303 is configured to reside within the external tubular member 1302. An external inside surface 1305 of the external tubular member 1302 may be finished to provide a low friction, rotary surface against an internal outside surface 1304 of the internal member 1303. At least a portion of the external tubular member 1302 may comprise external sintered polycrystalline diamond and at least a portion of the internal member 1303 may comprise internal sintered polycrystalline diamond. The external and internal polycrystalline diamond may rotate against each other and increase the life of the rotary bearing 1301.

Figure 14:
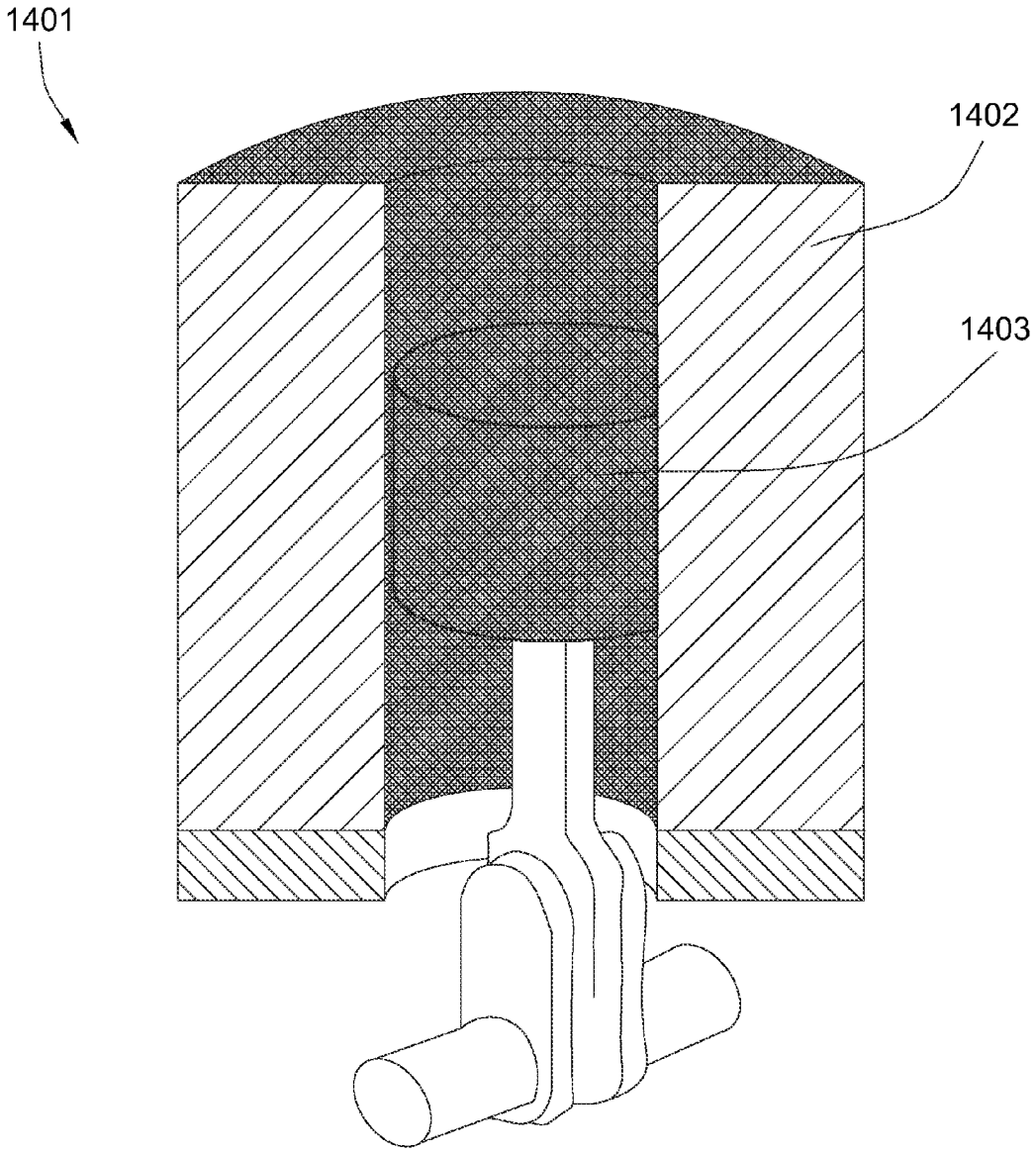
FIG. 14 is a partial-cross sectional view of an embodiment of a piston-cylinder device.

FIG. 14 discloses a partial-cross sectional view of an embodiment of a piston-cylinder device 1401. The piston-cylinder device 1401 may comprise an external tubular member 1402 and an internal member 1403 configured to reside within the external tubular member 1402. The external tubular member 1402 may comprise an external wall thickness comprising external sintered polycrystalline diamond and the internal member 1403 may comprise an internal width comprising internal sintered polycrystalline diamond.

The internal member 1403 may be configured to move axially within the external tubular member 1402. As shown in the present embodiment, the internal member 1403 may be configured to be a piston and the external tubular member 1402 may be configured to be a cylinder wherein the piston may translate within the cylinder. The internal and external polycrystalline diamond may slide against each other creating minimal friction and may reduce the amount of lubricant needed for proper functioning.

In some embodiments, the piston-cylinder device 1401 may be disposed within an engine. The external tubular member 1402 may comprise a compression area in which fuel may be injected. As the internal member 1403 moves axially, the fuel may be compressed and ignited such that an explosion occurs within the compression area. To further strengthen the external polycrystalline diamond, a plurality of cylinders may be heat shrunk around the external tubular member 1402. The heat shrunk cylinders may comprise sintered polycrystalline diamond. A heat shrunk cylinder may help keep the external tubular member 1402 and previously applied heat shrunk cylinders in compression.

Figure 15:
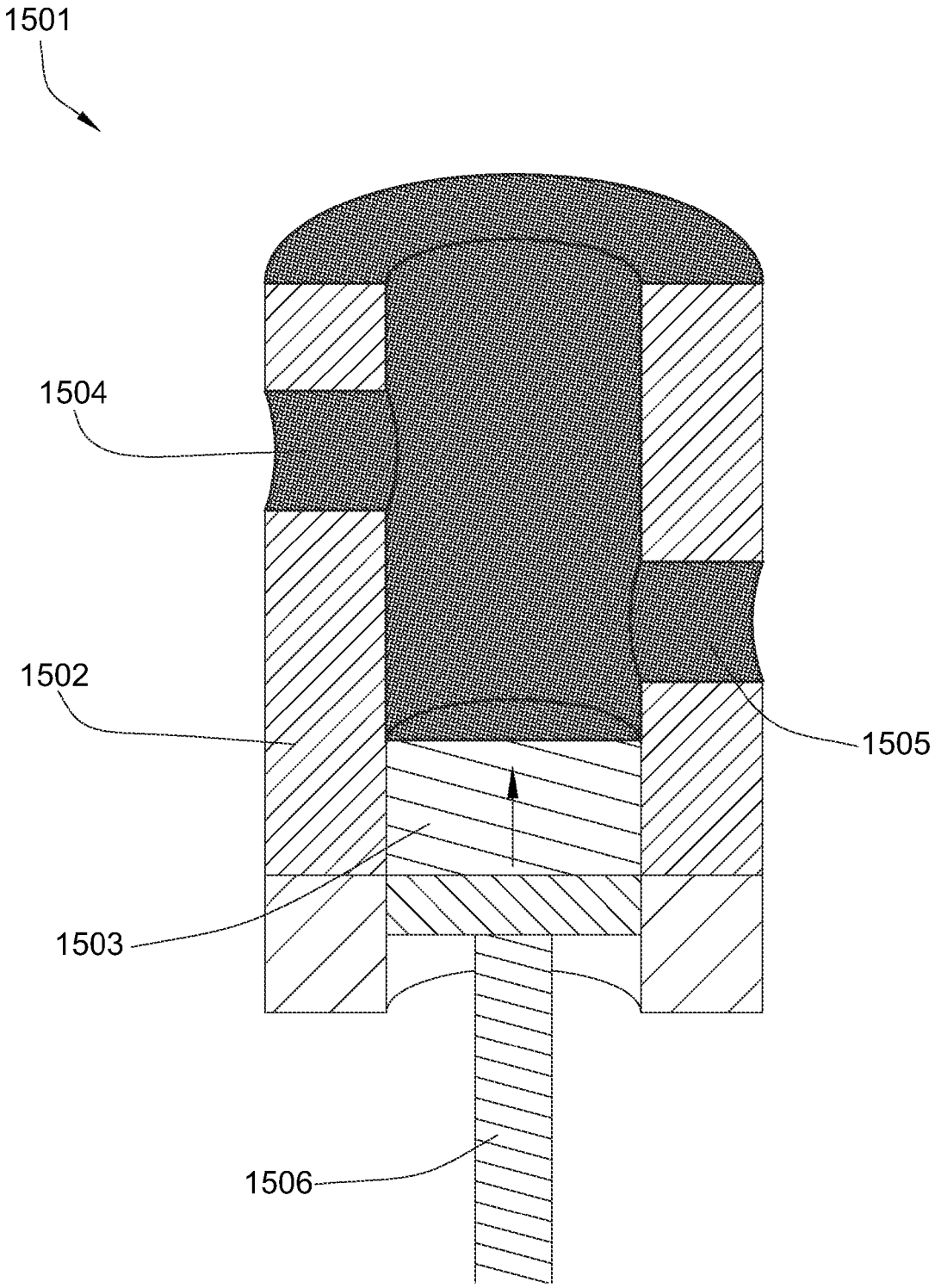
FIG. 15 is a cross-sectional view of an embodiment of a reciprocating valve.

FIG. 15 discloses a cross-sectional view of an embodiment of a reciprocating valve 1501. The reciprocating valve 1501 may allow and disallow a flow of fluid to pass from a first fluid passage into a second fluid passage. The reciprocating valve 1501 may comprise an external tubular member 1502 and an internal member 1503. The external tubular member 1502 may comprise an external wall thickness comprising external sintered polycrystalline diamond and the internal member

1503 may comprise an internal width comprising internal sintered polycrystalline diamond.

The external member may comprise a first external lateral bore 1504 and a second external lateral bore 1505 through which a fluid may flow. The internal member 1503 may move axially within the external tubular member 1502 to block and unblock at least one of the first or second external lateral bores 1504 and 1505 respectively. When the internal member 1503 blocks at least one of the first or second external lateral bores 1504 and 1505 respectively, the reciprocating valve 1501 may be closed and fluid may not be able to pass through. The internal member 1503 may be rigidly connected to a drive shaft 1506 which may be configured to axially move the internal member 1503.

Figure 16A:
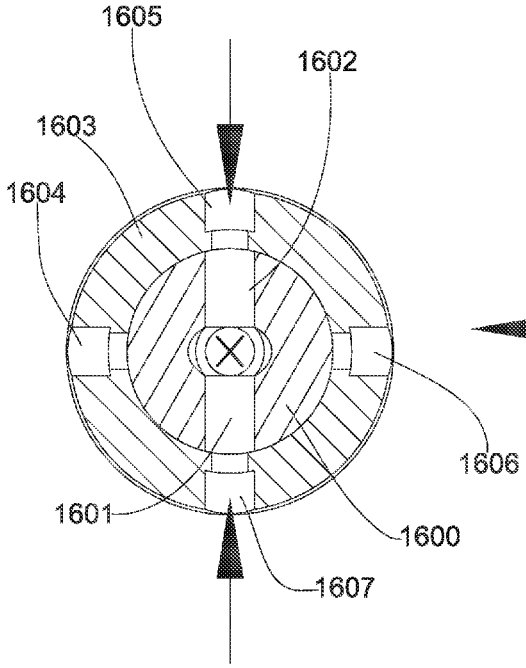
FIG. 16*a* is an orthogonal view of an embodiment of a molecular structure for polycrystalline diamond.

FIG. 16*a* discloses a central bore 1600 in the internal member 1650 that accommodates a flow of fluid. Side bores 1601, 1602 intersect with the central bore. The external tubular member 1603 comprises a plurality of lateral bores 1604, 1605, 1606, 1607. In the present embodiment, lateral bores 1605, 1607 are disclosed as supply bores that intake a fluid into the apparatus.

Figure 16B:
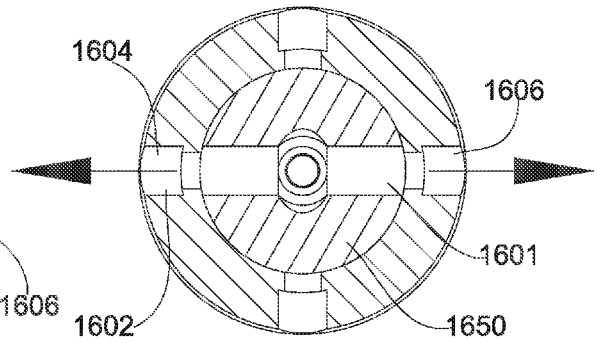
FIG. 16*b* is an orthogonal view of another embodiment of a molecular structure for polycrystalline diamond.

In the embodiment of FIG. 16*b*, the internal member 1650 is rotated so that the side bores 1601, 1602 are aligned with lateral bores 1604, 1606 so that the apparatus is configured to exhaust the fluid out.

Whereas the present invention has been described in particular relation to the drawings attached hereto, it should be understood that other and further modifications apart from those shown or suggested herein, may be made within the scope and spirit of the present invention.

What is claimed is:

1. An apparatus, comprising:

an external tubular member comprising an external outside surface and an external inside surface joined by an external wall thickness;

the external wall thickness comprises external sintered polycrystalline diamond;

an internal member residing within the external tubular member and comprising an internal outside surface and an internal width; and the internal width comprises internal sintered polycrystalline diamond;

wherein the external inside surface is adjacent to the internal outside surface.

2. The apparatus of claim 1, wherein a seal is formed intermediate the external inside surface and the internal outside surface.

3. The apparatus of claim 1, wherein the internal and external polycrystalline diamond comprises a metal catalyst concentration of five to twenty five percent by weight.

4. The apparatus of claim 1, wherein the external wall thickness further comprises external cemented metal carbide bonded to the external sintered polycrystalline diamond at an external interface.

5. The apparatus of claim 4, wherein the external interface is non-planar.

6. The apparatus of claim 1, wherein the external wall thickness further comprises external cemented metal carbide bonded to the external sintered polycrystalline diamond at first and second external interfaces.

7. The apparatus of claim 1, wherein the internal width further comprises internal cemented metal carbide bonded to the internal sintered polycrystalline diamond at an internal interface.

8. The apparatus of claim 1, wherein the external inside surface is finished to provide a low friction, rotary surface against the internal outside surface.

9. The apparatus of claim 1, wherein the internal member comprises a bore through the internal width and along a length of the internal member.

10. The apparatus of claim 9, wherein the bore and the internal outside surface of the internal member are joined by at least one internal lateral bore.

11. The apparatus of claim 1, wherein the internal member is configured to move axially within the external tubular member.

12. The apparatus of claim 1, the external outside surface and the external inside surface of the external tubular member are joined by at least one external lateral bore.

13. The apparatus of claim 1, wherein the external tubular member and the internal member form a rotary valve.

14. The apparatus of claim 1, wherein the external tubular member and the internal member form a reciprocating valve.

15. The apparatus of claim 1, wherein the external polycrystalline diamond is press fit within an external lateral bore formed between the external outside surface and the external inside surface.

16. The apparatus of claim 1, wherein the internal polycrystalline diamond is press fit within an internal lateral bore formed within the internal width.

17. The apparatus of claim 16, wherein the press fit polycrystalline diamond comprises at least one cylindrical structure.

18. The apparatus of claim 1, wherein the external polycrystalline diamond forms at least a portion of the external outside surface, the external inside surface, and the entire wall thickness therebetween.

19. The apparatus of claim 1, wherein the internal and external polycrystalline diamond comprise diamond grains with diameters between ten and twenty micrometers.

20. The apparatus of claim 1, wherein the internal member is rigidly connected to a drive shaft configured to rotate and/or axially translate the internal member within the external tubular member.

* * * * *